US009463895B2

(12) United States Patent
Moreau et al.

(10) Patent No.: US 9,463,895 B2
(45) Date of Patent: Oct. 11, 2016

(54) BOX HAVING CONVEX CENTRING ELEMENTS, AND BLANK FOR MANUFACTURING SUCH A BOX

(71) Applicant: Otor, Puteaux (FR)

(72) Inventors: Jean-Claude Moreau, Saint Brice (FR); Sebastien Jacomelli, Laives (FR); Quentin Serre de Lourtioux, Chateaubernard (FR)

(73) Assignee: Otor, Puteaux (FR)

( * ) Notice: Subject to any disclaimer, the term of this patent is extended or adjusted under 35 U.S.C. 154(b) by 0 days.

(21) Appl. No.: 14/398,493

(22) PCT Filed: May 7, 2013

(86) PCT No.: PCT/FR2013/051025
§ 371 (c)(1),
(2) Date: Nov. 3, 2014

(87) PCT Pub. No.: WO2013/167845
PCT Pub. Date: Nov. 14, 2013

(65) Prior Publication Data

US 2015/0083788 A1 Mar. 26, 2015

(30) Foreign Application Priority Data

May 9, 2012 (FR) ..... 12 01355

(51) Int. Cl.
*B65D 5/42* (2006.01)
*B65D 5/00* (2006.01)

(52) U.S. Cl.
CPC ..... *B65D 5/4266* (2013.01); *B65D 5/001* (2013.01); *B65D 5/427* (2013.01)

(58) Field of Classification Search
USPC ..... 493/137, 156; 229/120.11, 170, 173
See application file for complete search history.

(56) References Cited

U.S. PATENT DOCUMENTS

| | | | | |
|---|---|---|---|---|
| 4,913,291 | A * | 4/1990 | Schuster | 229/120.011 |
| 5,535,941 | A * | 7/1996 | Garza | 229/191 |
| 7,607,567 | B2 * | 10/2009 | Fry et al. | 229/178 |
| 8,827,142 | B2 * | 9/2014 | Smith | 229/108 |
| 2006/0163333 | A1 | 7/2006 | Kornacki | |
| 2009/0145955 | A1 * | 6/2009 | McLeod | B65D 5/003 229/169 |

(Continued)

FOREIGN PATENT DOCUMENTS

| | | | |
|---|---|---|---|
| EP | 0279754 | A2 | 8/1988 |
| FR | 2720052 | A1 | 11/1995 |
| FR | 2757833 | A1 | 7/1998 |

(Continued)

OTHER PUBLICATIONS

International Search Report of PCT/FR2013/051025, dated Sep. 2, 2013.

*Primary Examiner* — Christopher Demeree
(74) *Attorney, Agent, or Firm* — Banner & Witcoff, Ltd.

(57) ABSTRACT

The present invention relates to a box (30, 31) and a blank (1) made of corrugated cardboard sheet material having a polygonal cross section, including side walls (3, 4, 5, 6), an upper wall forming the top of the box and a lower wall forming the bottom of the box. The top of the box comprises at least one cut-out convex portion (26) in the upper wall, and the bottom comprises portions (18) which have a perforated surface having a complementary shape to the said convex portions, situated directly above the latter and arranged so as to be fitted into the convex portions of the box below.

14 Claims, 4 Drawing Sheets

(56) References Cited

U.S. PATENT DOCUMENTS

| | | | |
|---|---|---|---|
| 2011/0204127 | A1 | 8/2011 | Brundage et al. |
| 2011/0204131 | A1 | 8/2011 | Brundage et al. |

FOREIGN PATENT DOCUMENTS

| | | | |
|---|---|---|---|
| FR | 2761341 | A1 | 10/1998 |
| GB | 2280892 | A | 2/1995 |

* cited by examiner

BOX HAVING CONVEX CENTRING ELEMENTS, AND BLANK FOR MANUFACTURING SUCH A BOX

The present invention relates to a box made of corrugated cardboard sheet material having a polygonal cross section including side walls, an upper wall forming the top of the box and a lower wall forming the bottom.

It also relates to blanks for making up such a box.

It finds a particularly important, although not exclusive, application in the field of boxes that are stackable on a pallet, which may have a tendency to slide in relation to one another in the course of their handling during transport phases.

Systems for the centering of boxes to prevent them from sliding by the use of lateral studs interacting with orifices positioned on, or in proximity to, the ends are already known.

Such systems are fragile and do not withstand repeated handling.

Also previously known (FR 2 311 717) are packs in which the cover is formed by flaps, some of which have a shape that is complementary to the shapes of indentations arranged in the bottom, which is likewise formed by flaps permitting their fitting and consequently their lateral restraint.

This embodiment is not suitable for board materials with a low weight per unit area and does not always permit perfectly vertical stacking, because of the discrepancies that may exist during forming of the box.

The present invention proposes to make available a box made of corrugated cardboard sheet material which meets the practical requirements more closely than those boxes which are previously familiar, in particular because, on the one hand, it proposes centering of the boxes one on top of the other, thereby allowing sliding and lateral positioning before interlocking and locking without the risk of damaging the centering means that will be used and, on the other hand, because it permits simple and inexpensive forming of the boxes.

It will thus be possible with the invention to prevent any sliding of the boxes when they are stacked one on top of the other during their palletization and in so doing to permit the use of board material with a low weight per unit area, at the same time avoiding the use of expensive palletization accessories and generators of additional handling.

To this end, the present invention proposes in particular a box made of corrugated cardboard sheet material having a polygonal cross section, including side walls, an upper wall forming the top of the box and a lower wall forming the bottom of the box, characterized in that the top of the box comprises at least one cut-out convex portion in the upper wall, and in that the bottom comprises at least one portion which has a corresponding perforated surface having a complementary shape to the said convex portion, situated directly above the latter and arranged so as to be fitted into the convex portions of the box below.

The expression "convex portion" is used to denote a portion which protrudes slightly in relation to the surface of the upper wall, while remaining substantially in the same plane as the latter.

The expression "portion which has a perforated surface having a complementary shape" is used to denote a plane recess dimensioned in such a way that the part of the convex portion that is inserted therein comes into abutment against at least one part of the periphery of the recess, which permits the locking of the longitudinal and transverse movements in the horizontal plane of one box in relation to another.

In advantageous embodiments, it is possible, moreover, to draw upon one and/or other of the following provisions:

- The convex portion is formed by a tongue that is partially cut out in the upper wall, connected on one side to the junction zone between the said upper wall and an adjacent side wall by a side that is deformable by folding, and is cut out on its other sides in relation to the said upper wall (which will also be lifted slightly in order to adopt a shape that is convex or inclined by a few degrees, for example 3 to 5°, in relation to the surface of the wall when it is shaped);
- the upper wall is formed at least in part by a flap that is attached via a junction line that is non-rectilinear and/or is not aligned in a continuous manner with a corresponding side wall, the non-aligned part being situated directly above the said convex portions in order to form the side that is deformable by folding during the formation of the box.

The expression "not aligned in a continuous manner" is used to denote a junction line including a first portion (in one or more parts) that is parallel to and is situated at a first distance d from the bottom of the box and at least one second portion situated at a second distance d+e from the said bottom.

The non-rectilinear junction line and/or the one or more non-aligned part(s) that are situated at the distance d+e extend towards the exterior directly above or substantially directly above the part that is intended to be convex.

During folding of the flap, this misalignment mechanically generates the convexity of the portion.

In other words, the dimensional characteristic on the non-rectilinear or non-aligned junction lines thus brings about twisting and/or raising and/or convexity of the said cut-out portion on its other sides when the flaps are folded and are securely attached by adhesive bonding;

Advantageously, e lies between ⅛ and 1 thickness of the corrugated board, for example equal to half of the said thickness, for example where e lies between 0.5 and 4 mm;

- the lower wall and the side walls are formed by a tray, and the upper wall is formed by a cover;
- the box has eight sides, namely four principal side walls and four intermediate side walls, forming cut corners;
- the box comprises at least two convex portions, which are symmetrical in relation to the center of the box;
- the box comprises two sets of two convex portions, which are symmetrical in relation to the transversal axis of the box;
- the upper wall is formed at least in part by two flaps, the convex portions being pre-cut into the corresponding flap by a line in the form of a flattened Ω of which the summit faces towards the interior of the box.

The invention also proposes a blank enabling such a box to be obtained.

It also proposes, in particular, a blank or a set of blanks made of corrugated cardboard sheet material intended to form a box having a polygonal cross section, including side walls, an upper wall and a lower wall forming the bottom of the box, characterized in that the upper wall is formed by at least one flap that is attached to the top of the adjacent side wall via a junction line exhibiting at least one section of a line that is not rectilinear and/or is not in alignment with the rest or the line forming the folding line, and at least one portion that is partially cut out in the said flap directly above or substantially above and in proximity to the said part of a non-rectilinear line, in order to form a convex portion projecting in relation to the top surface of the box during the formation of the said box, and in that the base comprises at least one portion of a corresponding perforated surface situated directly above and having a complementary shape to the said convex portion.

The expression "in proximity to" is intended to denote sufficiently close for the partially cut-out portion to be influenced in its shape at the time of folding in order to adopt a convex configuration, for example at a distance of between ½ and 3 thicknesses of the board, or a few millimeters, for example between 5 mm and 15 mm from the folding line.

Advantageously, the blank comprises four flaps forming the lower wall of the base, and the upper wall comprises at least two partially cut-out portions, which are symmetrical in relation to the center of the blank, in order to constitute the convex parts during the formation of the box.

In another advantageous embodiment, the set of blanks comprises a first blank for forming the bottom of the box and a second blank forming the upper wall, the said upper wall comprising at least two partially cut-out portions that are symmetrical in relation to the center of the second blank, in order to constitute the convex parts during the formation of the box.

Advantageously, the blank or the set of blanks comprises two sets of two partially cut-out portions that are symmetrical in relation to the transversal axis of the blank.

Advantageously, the blank or the set of blanks likewise comprises two flaps for forming at least one part of the upper wall, and/or the previously partially cut-out portions are cut out in the upper wall by a line in the form of a flattened Ω of which the summit faces towards the side opposite the corresponding folding line.

The invention will be more readily appreciated from a perusal of the following description of embodiments that are provided below by way of non-restrictive examples. The description makes reference to the accompanying drawings, in which:

Throughout this description, the same reference numbers will be used, wherever possible, to designate the same elements or similar elements.

FIG. 1 depicts a blank 1 made of corrugated cardboard sheet material, for example having a thickness of 3 mm, intended to form a box of rectangular section.

Figures 1, 1A:
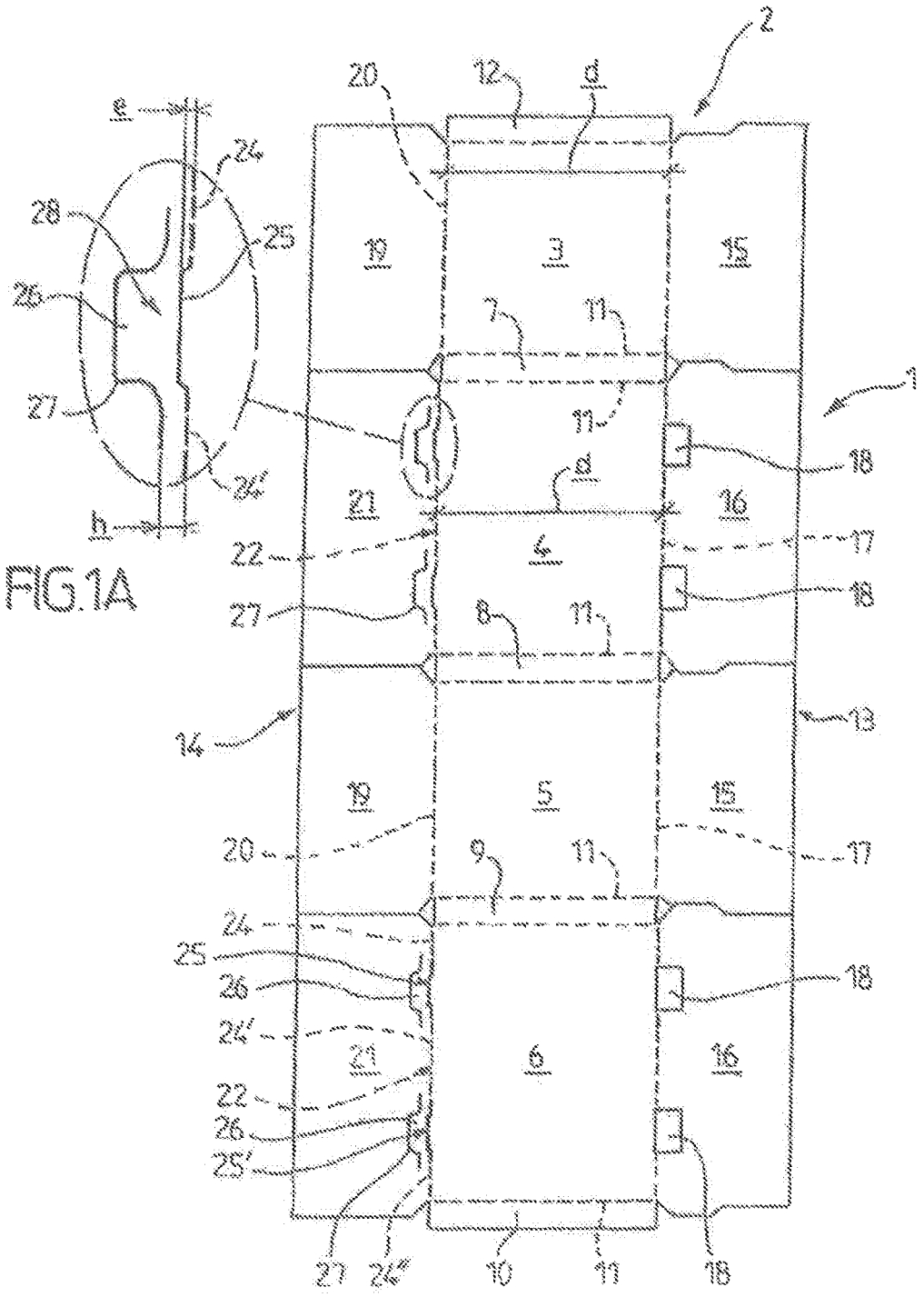
FIG. 1 is plan view from above of a blank according to a first embodiment of the invention.
FIG. 1A is a detail of FIG. 1.

The blank 1 includes a belt consisting of four principal walls or panels 3, 4, 5, 6 separated by intermediate panels 7, 8, 9 and 10 connected together by parallel folding lines 11.

The belt 2 likewise includes at its extremity a gluing tongue 12 which is caused to interact with the intermediate panel 10 situated at the other end of the blank.

The blank 1 comprises two series 13 and 14 of flaps.

More specifically, it comprises a series 13 provided with two identical, substantially rectangular flaps 15 exhibiting lateral edges having slanting extremities on the side of the belt for the purpose of forming an upper wall occupying the totality of the surface of the box formed from the blank, and with two flaps 16 that are likewise identical to each other, having a shape similar to the flaps 15.

Each of the flaps is connected to the adjacent panel, in the case of the flaps 15 respectively to the panels 3 and 5, and in the case of the flaps 16 respectively to the panels 4 and 6, by folding lines or creases 17.

The two flaps 16 include at the level of the folding lines 17 two rectangular recesses 18 which will be explained below.

According to the embodiment of the invention described more particularly here, the blank also includes a second series 14 of flaps, comprising two types of flap, namely substantially rectangular flaps 19 having lateral edges exhibiting a smaller angle in order to adapt to the cut corners formed by the panels 7, 8, 9, 10, attached to the panels 3 and 5 by folding lines 20, and flaps 21 of similar shape to the flaps 19, attached to the panels 4 and 6 by folding lines 22.

The folding lines 22 are junction lines that are non-rectilinear and/or non-aligned in a continuous manner, which are divided into three aligned parts 24, 24' and 24" forming a folding line, and are separated in twos by two misaligned parts 25, 25', which, as will be seen, bring about the desired convex shape during folding of the box.

Tongues 26, capable of forming the convex portions of the box once it has been formed, are provided. They are constituted by previously cut-out portions in the corresponding flap 21 by a line 27 in the form of a flattened Ω of which the summit faces towards the exterior of the box.

Present on the base formed by the flaps 16 situated directly above and face-to-face with these tongues 26, and intended to protrude, are the recessed portions 18 of rectangular form, which at least in part exhibit a complementary shape, and which will be capable of being fitted into the convex parts during the formation of the box.

In order to be able to permit the fitting of the convex part, one of the sides of the recesses 18 slightly overlaps the folding line 17, for example by a value lying between 0 mm and e, for example for a distance of 0, 5 mm or 1 mm.

Illustrated in FIG. 1A is an enlarged view of the portion intended to form the convex portion revealing the offset e between the portions 24, 24' and 25 of the folding lines 22.

The tongue 26, of rectangular shape, previously cut out on three of its sides in the shape of a Ω, is connected to the rest of the flap by the part 28, the distance h between the edges that are substantially parallel to the folding line 24, of the Ω being in this case, for example, equal to 1, 5 to 3 times the thickness of the board, for example in the range between 3 and 8 mm, for example 5 mm.

These provisions will bring about the particular convex form.

Figure 2:
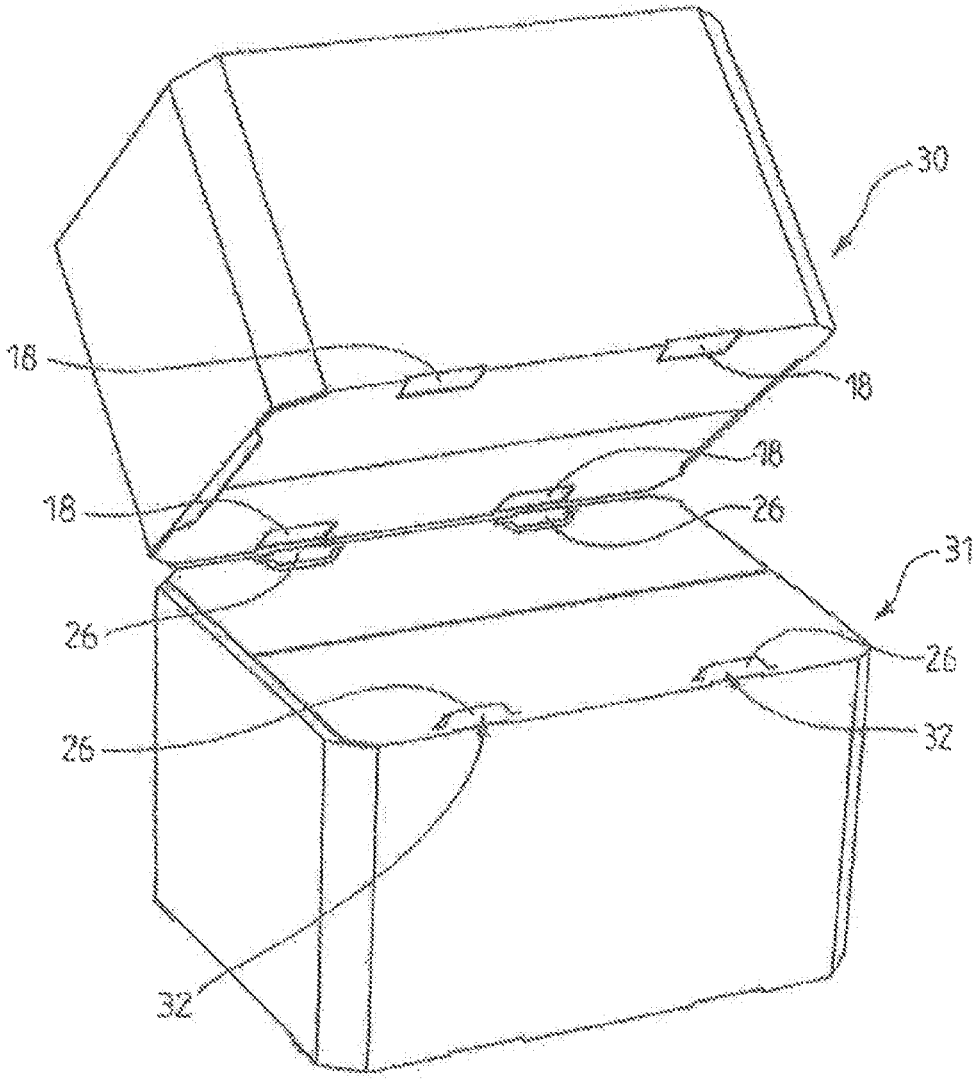
FIG. 2 is a view in perspective depicting the interlocking of two boxes obtained from the blank in FIG. 1.

Depicted in FIG. 2 are two boxes 30 and 31 stacked one on top of the other in a fitting position.

The top box 30 includes four recesses 18, which interact with the tongues 26 above which they are situated directly, and which form the convex portions 32 that are obtained thanks to the offset of the line or the crease 25, which, on closing the flap, causes the previously cut-out tongue 26 to lift slightly.

Figure 3:
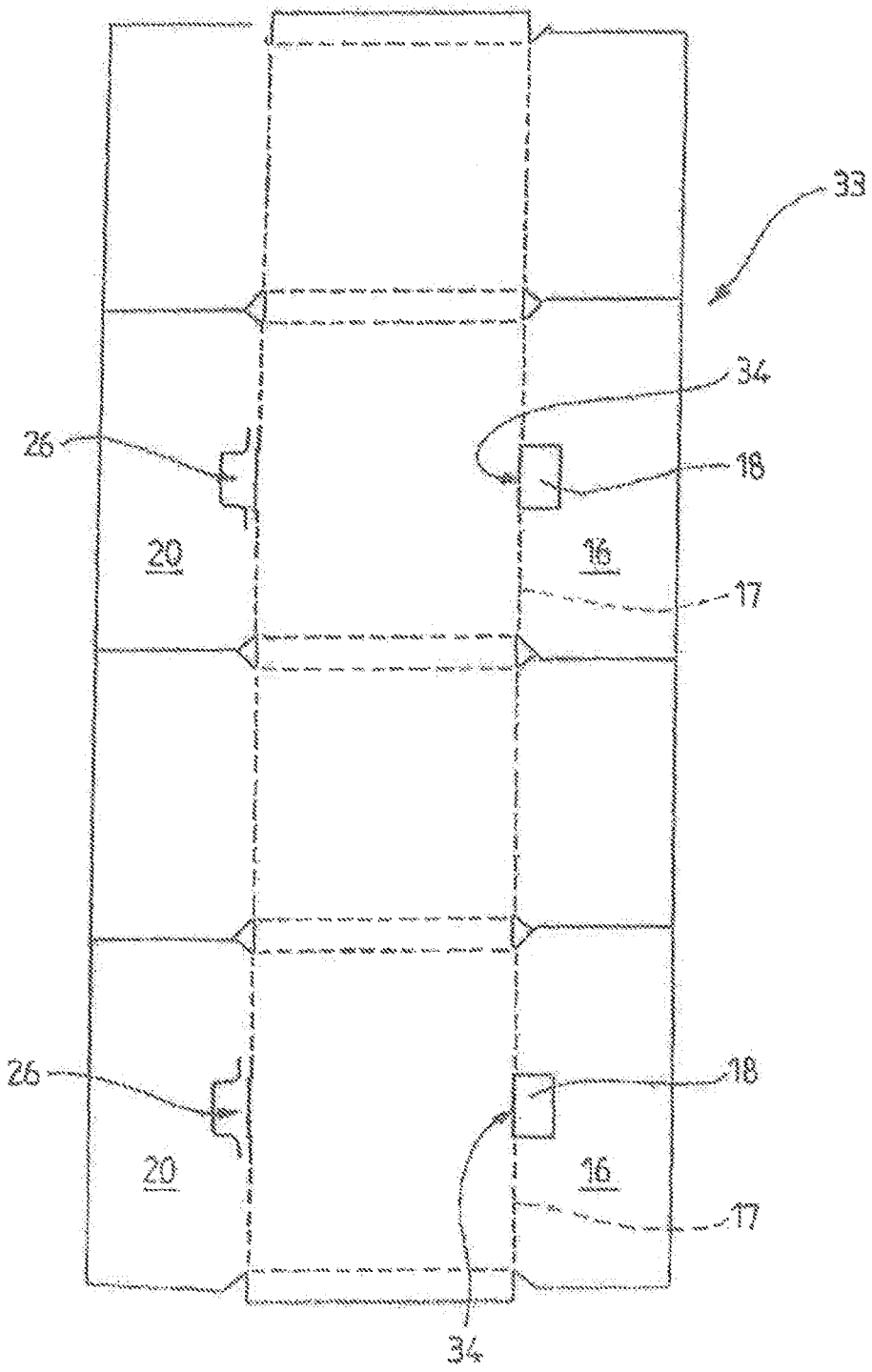
FIG. 3 is a plan view from above of a blank according to a second embodiment of the invention.

FIG. 3 illustrates another embodiment of a blank 33 with eight sides, having a single tongue 26 centered in relation to the flap 20 and an additional recess 18 per flap 16.

Each of these rectangular recesses includes a previously cut-out side on, and/or slightly astride, the corresponding folding line 17, for example extending beyond the said folding line 17 by one third or by one half of the thickness of the corrugated board.

Figure 4:
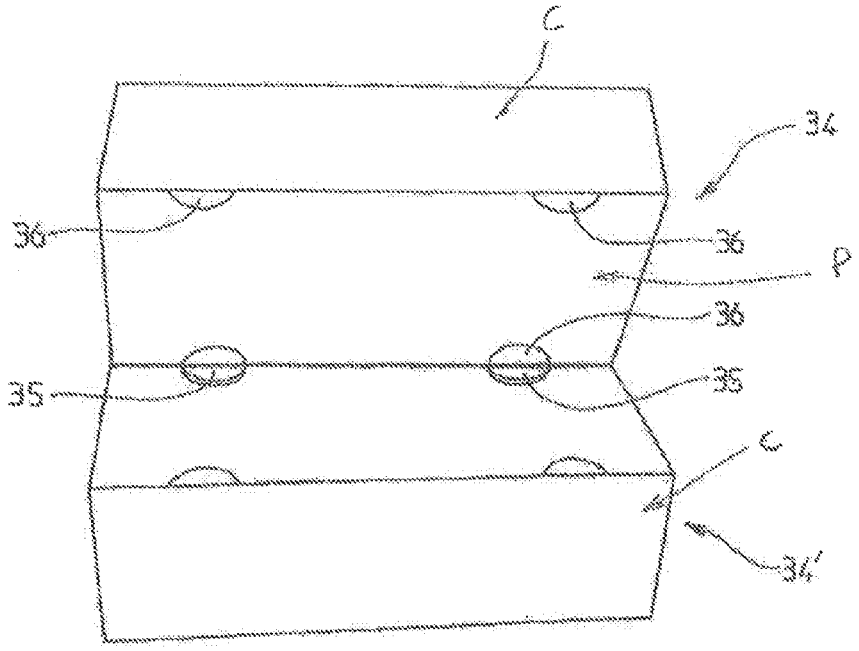
FIGS. 4 and 5 are views in perspective from above depicting the interlocking of two boxes having convex parts according to another embodiment of the invention.
Figure 5:
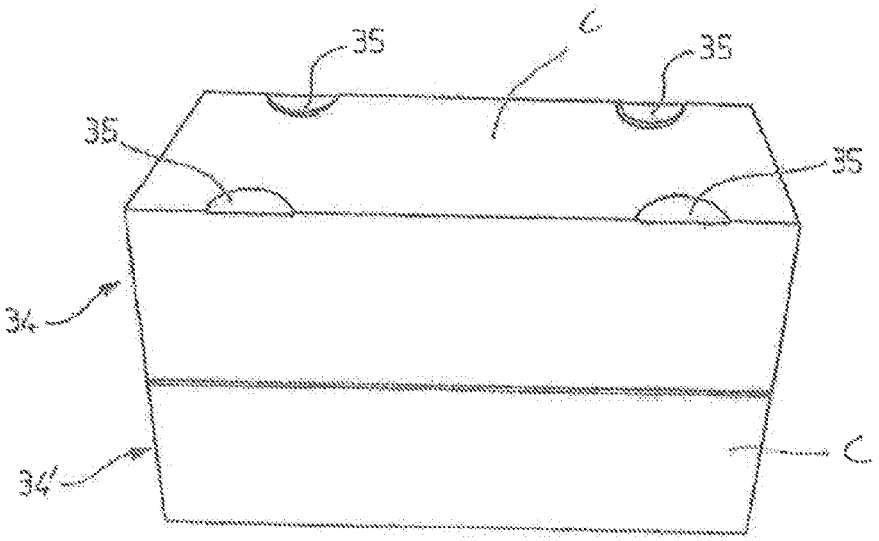

Depicted in FIGS. 4 and 5 is another example of a pile of parallelepipedic boxes 34, 34' produced according to another embodiment of the invention, utilizing a cover C forming the upper covering wall in its totality (or partially), and a lower plate P forming the lower wall. The convex portions 35 in this case, instead of exhibiting a substantially rectangular shape, exhibit a rounded shape as a portion of a circle and will therefore interact with recesses 36 of complementary shape that are likewise in the shape of a portion of a circle (semicircles, for example).

The method of forming a box according to the invention will now be described with reference to FIGS. 1 and 2.

Starting with the blank 1 in FIG. 1, the box is formed by folding down the lateral faces.

In order to do this, the box is formed, after gluing the tongue 12, in an automatic manner, by folding the longitudinal lateral faces 3, 4, 5, 6, for example around a mandrel of complementary shape to the box to be formed, and by then folding down the previously glued flaps 15, onto which the flaps 16 that are thus fixed above by gluing are then applied on the exterior.

Then, after filling the box, the upper wall is closed by first folding down the previously glued flaps 19, onto which the flaps 20 that are folded about corresponding folding lines 22 are then applied.

During folding, the offset of the lines 24, 24', 24" with the lines 25, 25' then brings about structurally, at the time of forming, an effect of convexity or slight lifting of the tongues or the previously cut-out portions 26.

This convexity effect, which imparts an excrescence or a slight protrusion (for example 2 to 10 mm) in relation to the surface of the upper face of the box, permits the creation of a centering element arranged to be fitted into the perforated surfaces or the recesses 18 in the base of the box.

Depending on the weight per unit area and the thickness of the corrugated board, a more or less pronounced spring effect is obtained that a person skilled in the art will be capable of adapting as a function of the utilization of the box (due notably to the weight of the products placed in the box).

Thanks to fitting of this kind, excellent stability between the boxes is thus obtained in a simple manner.

As expected, and in view of the foregoing, the present invention is not restricted to the embodiments that are described more particularly here. On the contrary, the invention encompasses all variants and, in particular, those in which the shape of the convex portions is different, those in which the flaps or tongues are trapezoidal or rectangular, glued to an adjacent flap or to a lateral face on the exterior and exhibit shapes associated with a box having eight sides with cutaways, and/or a box simply having four side walls, or also the case in which the base is formed from a single piece and the upper part of the box is formed from four flaps, or vice versa, the case in which the upper part of the box is formed by a cover that is fitted into or covers the lower part forming a plats to which it is fixed by gluing and/or by fitting of tongues, which are capable of being separated one from the other, whether or not in an easy manner, by simple external lateral traction.

The invention claimed is:

1. A box made of corrugated cardboard sheet material and having a polygonal cross section, including side walls, an upper wall forming a top of the box and a lower wall forming a bottom of the box, the upper wall and the side walls being connected through folding lines, wherein the top of the box comprises at least one cut-out convex portion which protrudes slightly in relation to the upper wall while remaining substantially in a same plane as the upper wall, and the bottom of the box comprises at least one corresponding portion having a perforated surface and having a complementary shape to the convex portion, situated opposite the convex portion and arranged so as to be fitted into a convex portion of a box below, wherein the convex portion is formed by a tongue that is partially cut out in the upper wall, connected on one side that is deformed by folding in a junction zone between the upper wall and an adjacent one of the side walls, and is cut out on its other sides in relation to the upper wall, and wherein the upper wall is formed at least in part by a flap that is attached in the junction zone to the adjacent one of the side walls, via one of the folding lines that includes a first part of the one of the folding lines that is not in alignment with a second part of the one of the folding lines, the first part of the one of the folding lines being situated substantially opposite the convex portion in order to form the side that is deformed by folding in the junction zone.

2. The box as claimed in claim 1, wherein the upper wall is formed at least in part by two flaps, the convex portion being pre-cut into a corresponding flap by a line in the form of a flattened Ω of which a summit faces towards an interior of the box.

3. The box as claimed in claim 1, wherein the lower wall and the side walls are formed by a tray and the upper wall is formed by a cover.

4. The box as claimed in claim 1, and having a center wherein the box comprises at least two convex portions, which are symmetrical in relation to the center of the box.

5. The box as recited in claim 4, wherein the at least two convex portions have a generally rounded shape as a portion of a circle.

6. The box as claimed in claim 1, and having a transversal axis wherein the box comprises two sets of two convex portions, which are symmetrical in relation to a transversal axis of the box.

7. A blank or a set of blanks made of corrugated cardboard sheet material intended to form a box having a polygonal cross section and including side walls, an upper wall and a lower wall forming a bottom of the box, wherein the upper wall is formable by at least one flap that is attached to a top of an adjacent one of the side walls in a junction zone via a folding line that includes a first part of the folding line that is not in alignment with a second part of the folding line, wherein at least one portion is connected on a deformable side in the junction zone and is partially cut out in the flap on its other sides, the deformable side being substantially opposite and in proximity to the first part of the folding line, in order to form, upon folding on the deformable side, a convex portion that protrudes slightly in relation to a top surface of the box while remaining substantially in a same plane as the top surface, and wherein the bottom comprises at least one portion of a corresponding perforated surface having a complementary shape to the convex portion.

8. The blank or set of blanks as claimed in claim 7, wherein the first part of the folding line is parallel to and is offset from the second part of the folding line by a distance e, wherein e lies between 1 and 5 mm.

9. The blank or the set of blanks as claimed in claim 8, wherein the blank or the set of blanks comprises two sets of two partially cut-out portions that are symmetrical in relation to a transversal axis of the blank.

10. The blank or set of blanks as claimed in claim 7, wherein the blank or set of blanks comprises four flaps forming the lower wall of the bottom of the box, and the upper wall comprises at least two partially cut-out portions, which are symmetrical in relation to a center of the blank, in order to constitute the convex portion during formation of the box.

11. The blank or set of blanks are recited in claim 10, wherein the at least two partially cut-out portions have a generally rounded shape as a portion of a circle.

12. The blank or set of blanks as claimed in claim 7, wherein the set of blanks comprises a first blank for forming the bottom of the box and a second blank forming the upper wall, the said upper wall comprising at least two partially cut-out portions that are symmetrical in relation to a center of the second blank, in order to constitute the convex portion during formation of the box.

13. The blank or the set of blanks as claimed in claim 7, wherein the at least one portion is cut out in the upper wall by a line in the form of an Ω of which a summit faces towards a side opposite the first part of the folding line.

14. The blank or the set of blanks as claimed in claim 7, wherein the blank or the set of blanks comprises two flaps in order to form the upper wall at least in part.

* * * * *